US006572684B2

(12) United States Patent
Iwata et al.

(10) Patent No.: US 6,572,684 B2
(45) Date of Patent: Jun. 3, 2003

(54) CHARGEABLE TOW, LAMINATES USING THE SAME AND PROCESSED GOODS THEREFROM

(75) Inventors: Masuo Iwata, Shiga (JP); Kanemitsu Fuchigami, Shiga (JP)

(73) Assignees: Chisso Corporation, Osaka (JP); Chisso Polypro Fiber Company Limited, Tokyo (JP)

( * ) Notice: Subject to any disclaimer, the term of this patent is extended or adjusted under 35 U.S.C. 154(b) by 0 days.

(21) Appl. No.: 10/034,474

(22) Filed: Dec. 27, 2001

(65) Prior Publication Data

US 2002/0119312 A1 Aug. 29, 2002

(30) Foreign Application Priority Data

Dec. 27, 2000 (JP) ..... 2000-397182
Sep. 17, 2001 (JP) ..... 2001-281584

(51) Int. Cl.[7] ..... B03C 3/28; B03C 3/30

(52) U.S. Cl. ..... 96/17; 15/209.1; 55/524; 55/528; 55/DIG. 39; 96/69; 442/110

(58) Field of Search ..... 96/15, 17, 69, 96/98–100; 55/524, 528, DIG. 5, DIG. 39, DIG. 43, DIG. 45; 95/59; 442/110–112; 264/DIG. 48; 15/209.1, 225, 229.12

(56) References Cited

U.S. PATENT DOCUMENTS 3,063,870 A * 11/1962 Wakeman et al. ..... 442/112
5,057,710 A * 10/1991 Nishiura et al. ..... 307/400
5,411,576 A * 5/1995 Jones et al. ..... 95/57
5,525,261 A * 6/1996 Incorvia et al. ..... 252/500
5,529,838 A * 6/1996 Lee ..... 442/414
5,645,627 A * 7/1997 Lifshutz et al. ..... 96/15
5,736,469 A * 4/1998 Bhattacharjee et al. ..... 442/110
5,834,386 A * 11/1998 Cohen ..... 442/382
5,888,274 A * 3/1999 Frederick ..... 95/59
5,935,303 A * 8/1999 Kimura ..... 96/69
5,976,208 A * 11/1999 Rousseau et al. ..... 55/385.3
6,030,484 A * 2/2000 Maeoka et al. ..... 156/309.9
6,123,752 A * 9/2000 Wu et al. ..... 96/69
6,146,436 A * 11/2000 Hollingsworth et al. ..... 55/486
6,235,660 B1 * 5/2001 Bhattacharjee et al. ..... 442/110
6,436,855 B1 * 8/2002 Iwata et al. ..... 442/99

FOREIGN PATENT DOCUMENTS

JP 5-214655 * 8/1993

OTHER PUBLICATIONS

References X'd not supplied becoause this action is a first action allowance and Japanese patent document was cited by applicants on page 3 of the specification.*

* cited by examiner

*Primary Examiner*—Richard L. Chiesa
(74) *Attorney, Agent, or Firm*—Fay, Sharpe, Fagan, Minnich & McKee, LLP

(57) ABSTRACT

To provide chargeable tow and a laminate thereof, which can be produced with no restriction by the production or processing method, and without troubles such as twining on a roll or single thread snapping caused by static electricity generated in the production steps. Tow, in which the value (D/W) obtained by dividing the total fineness of tow (D) by the tow width (W) is 1,000 to 8,000 dtex/mm, is produced by making a fiber-processing agent adhere thereto, preferably using a particular amount of the agent, wherein the agent has a particular structure and contains a polyoxyethylene higher fatty acid ester and a sorbitan fatty acid ester in a particular blending ratio.

18 Claims, No Drawings

CHARGEABLE TOW, LAMINATES USING THE SAME AND PROCESSED GOODS THEREFROM

BACKGROUND OF THE INVENTION

1. Field of the Invention

The present invention relates to tow having good chargeability and excellent workability. More particularly, the invention relates to tow which has very good adaptability as raw material for such a processed goods as air filter, wiper, etc., and laminate derived therefrom, though it has good chargeability, since its chargeability does not influence adversely on the processing step.

2. Description of the Related Art

In fiber, particularly synthetic fiber, static electricity that is generated by friction between fiber—fiber, fiber-metal, or fiber-air is an obstacle to the process of fiber spinning, drawing, spinning or processing of non-woven fabric. This is well known to cause feather bristling, twining around a roller, and yarn breaking and result in decrease of the quality and decrease of the productivity. In order to avoid troubles caused by static electricity, various methods for reducing generation of the static electricity or for eliminating the static electricity generated have been proposed. In the former method, a fiber-processing agent is applied on the fiber surface to improve smoothness. As the latter methods, a method for applying an anti-static agent on the fiber surface, a method for using as a raw resin of synthetic fiber a resin for which a component having an anti-static property has been copolymerized, and a method for fiber spinning a mixture of resin and an anti-static agent under melting, are exemplified.

On the other hand, in recent years, a filter or wiper for collecting dust in which chargeability of fiber is utilized has been required, so that synthetic fiber having chargeability has been desired in many cases in response to such requirements. Particularly, a long and thick bundle of tow which is made by tying synthetic fiber produced in the process for yarn-making and afforded chargeability is a good raw material for the goods. In producing such a good as filter or wiper, however, when the convergence or disentanglement of tow becomes worse by influence of static electricity, workability for the goods such as a dust-collecting filter or wiper utilizing chargeability decreases markedly. Therefore, it was very difficult to obtain such tow in which the chargeability and the workability are compatible.

In a common method for producing tow in which the chargeability and the workability are compatible, an anti-static agent is applied to synthetic fiber in the process for yarn-making, and thus resulting synthetic fiber to which has adhered the anti-static agent is used in production of tow. Then, the adhered anti-static agent is washed out well with water or an organic solvent. In this step, however, it is more suitable to wash tow goods in the final shape such as filters or wipers (hereinafter sometimes referred to as the processed goods) than to wash the tow itself, because there is no risk that the workability decreases due to static electricity generated in the respective steps leading to the processed goods. Any of washing steps for the tow itself or for the processed goods of the final shape, however, require an additional step for removing water or an organic solvent adhering to the processed goods, as well as steps for drying or recovering the solvent.

Japanese Patent Laid-Open No. 214655/1993 discloses a method for coating the fiber surface with an electret thermoplastic resin such as polybutene-1, and describes that synthetic fiber having good chargeability can be provided by the method. This patent also describes that the presence of a conductive material on the surface or in the inside of the fiber is not preferred to attain the object. Therefore, the synthetic fiber is intended to be produced by a dry-fiber spinning method such as a span-bonding method or melt-blowing method in which no adhesion of any fiber-processing agent is necessary. In addition, there is an alternative method for obtaining non-woven fabrics by span lace processing in which a fiber-processing agent can be washed out. In this method, however, an additional step as mentioned above is required. In the other common method for production using no fiber-processing agent, there occurs the above-mentioned disturbance as defect of the method due to friction to decrease quality of the product and productivity. Accordingly, at present there is no method adaptable for production of tow, in which the chargeability and the workability are compatible.

SUMMARY OF THE INVENTION

The present inventors worked assiduously to develop tow which can inhibit such a harmful effect as twining on a roll or single thread snapping due to static electricity generated in the production process. As a result, it was found that tow which comprises synthetic fiber of thermoplastic resin, of which the fineness of single yarn is 0.5 to 100 dtex, in which each synthetic fiber has crimps, and the value (D/W) obtained by dividing the total fineness (D) of the tow by the tow width (W) is 1,000 to 8,000 dtex/mm, and to which a fiber-processing agent containing a polyoxyethylene higher fatty acid ester of a particular structure and a sorbitan fatty acid ester at a particular ratio has preferably adhered in a particular amount, has incompatible characters, i.e., excellent chargeability and workability in processing into a filter or wiper without causing such a harmful effect as twining on a roll or single thread snapping in the steps of producing tow. The invention was completed based on these findings. As clearly seen from the above description, the object of the invention is to provide tow having excellent workability in processing into a filter or wiper, even though it has chargeability, laminate derived therefrom and processed goods therefrom.

The present invention is constituted as follows.

(1) Chargeable tow which comprises synthetic fiber of thermoplastic resin, of which the fineness of single yarn is 0.5 to 100 deci-tex (dtex), in which each synthetic fiber has crimps, the total fineness is 10,000 to 300,000 dtex, and the value (D/W) obtained by dividing the total fineness of the tow (D) by the tow width (W) is in a range of 1,000 to 8,000 dtex/mm, and of which the leak electric resistance is $1\times10^{10}$ Ω or more.

(2) Chargeable tow which comprises synthetic fiber of thermoplastic resin, of which the fineness of single yarn is 0.5 to 100 deci-tex (dtex), in which each synthetic fiber has crimps, the total fineness is 10,000 to 300,000 dtex, and the value (D/W) obtained by dividing the total fineness (D) of tow by the tow width (W) is in a range of 1,000 to 8,000 dtex/mm, and to which has adhered a fiber-processing agent containing the following components A and B (60 to 95% by weight of the component A and 5 to 40% by weight of the component B, based on the fiber-processing agent).

Component A

A mixture of a polyoxyethylene higher fatty acid ester of the following general formula (1) and one or more species of a sorbitan fatty acid ester of the following general formula (2) or (3):

Component B

Polyoxyethylene higher fatty acid ester of the following general formula (4) and/or general formula (5):

[General Formula (1)]

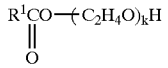

(In the formula, $R^1$ is a saturated or unsaturated aliphatic hydrocarbon group of 5 to 18 carbon atoms; and k is an integer of 2 to 50).

[General Formula (2)]

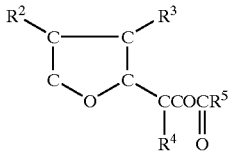

[General Formula (3)]

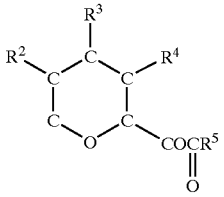

(In the general formulae (2) and (3), $R^2$, $R^3$ and $R^4$ each is a hydroxyl group or polyoxyethylene group, wherein the polymerization degree of the polyoxyethylene group (repeated unit of the polyoxyethylene group) is 2 to 55; and $R^5$ is a saturated or unsaturated aliphatic hydrocarbon group of 16 to 30 carbon atoms).

[General Formula (4)]

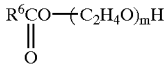

(In the formula, $R^6$ is a saturated or unsaturated aliphatic hydrocarbon group of 16 to 30 carbon atoms; and m is an integer of 2 to 50).

[General Formula (5)]

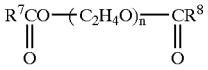

(In the formula, $R^7$ and $R^8$ each is a saturated or unsaturated aliphatic hydrocarbon group of 16 to 30 carbon atoms; and n is an integer of 2 to 50).

(3) Chargeable tow as described in the above item (2), wherein the fiber-processing agent adheres at a rate of 0.1 to 1.5% by weight for the tow.

(4) Chargeable tow as described in the above item (1) or (2), wherein the synthetic fiber composing tow has the apparent crimp number of 5 to 30 crimps/25 mm.

(5) Chargeable tow as described in any one of the above items (1) to (4), wherein the fineness of the single yarn is 1 to 30 dtex and the total fineness is 50,000 to 200,000 dtex.

(6) Chargeable tow as described in any one of the above items (1) to (5), wherein the value (D/W) obtained by dividing the total fineness of the tow (D) by the tow width (W) is in 2,500 to 5,000 dtex/mm.

(7) Chargeable tow as described in the above item (1) or (2), wherein the synthetic fiber composing the tow is of thermoplastic resin selected from polyolefins, polyesters and polyamides.

(8) Chargeable tow as described in the above item (1) or (2) wherein the synthetic fiber composing the tow is conjugate fiber composed of a low melting thermoplastic resin and a high melting thermoplastic resin.

(9) Chargeable tow as described in the above item (8), wherein at least one of the thermoplastic resins composing the conjugate fiber is an olefin resin, which is continuously exposed on a part of the surface of the fiber parallel to the direction of the long axis of the fiber.

(10) Laminate in which at least one selected from other non-woven fabrics, films, pulp sheets, knitting, and woven textiles is laminated on the chargeable tow as described in any one of the above items (1) to (9).

(11) A filter comprising the chargeable tow as described in any one of the above items (1) to (9).

(12) A wiper comprising the chargeable tow as described in any one of the above items (1) to (9).

(13) A filter comprising the laminate as described in the above item (10).

(14) A wiper comprising the laminate as described in the above item (10).

DESCRIPTION OF THE PREFERRED EMBODIMENTS

The tow as set forth in the above item (1) of the invention is chargeable tow which comprises synthetic fiber of thermoplastic resin, of which the fineness of single yarn is 0.5 to 100 deci-tex (dtex), in which each synthetic fiber has crimps, the total fineness is 10,000 to 300,000 dtex, and the value (D/W: hereinafter referred to as tow density) obtained by dividing the total fineness of the tow (D) by the tow width (W) is in a range of 1,000 to 8,000 dtex/mm, and of which the leak electric resistance is $1\times10^{10}$ Ω or more.

Though such tow has excellent chargeability as its characteristic caused by friction between fiber and metal, fiber and fiber, or fiber and other materials, generation of static electricity is suppressed at such a degree that it does not bring about a harmful effect such as twining on a roll or single thread snapping due to static electricity in the production process of the tow. Thus, tow having a uniform tow density and good convergence can be obtained with less generation of fracture. Moreover, the tow and the laminate in which at least one selected from other non-woven fabrics, films, pulp sheets, knitting and woven textiles is laminated on the tow, are excellent as raw materials for air filters or wipers, by which dust can efficiently be caught due to the chargeability of the tow.

The thermoplastic resin as raw material for synthetic fiber composing the tow of the invention includes preferably thermoplastic resins selected from polyolefins, polyesters and polyamides. For example, polyolefins such as polypropylene, high-density polyethylene, medium-density polyethylene, low-density polyethylene, linear low-density polyethylene, binary or ternary copolymer of propylene with olefins other than propylene; polyamides represented by nylon 6, nylon 66, etc.; polyesters such as polyethylene terephthalate, polybutylene terephthalate, low-melting polyesters derived from diols on copolymerization with terephthalic acid/isophthalic acid, polyester elastomer; and fluorocarbon resins are exemplified. These thermoplastic resins may be used alone or as a mixture of two or more.

The synthetic fiber composing the tow of the invention may be produced by means of melting fiber spinning of the above-mentioned thermoplastic resin. The synthetic fiber may be either a single fiber produced by means of melt fiber spinning one of or a mixture of two or more of the thermoplastic resins or conjugate fiber produced from two or more of the thermoplastic resins. It is preferable however to be conjugate fiber composed of a low-melting thermoplastic resin and a high-melting thermoplastic resin.

In the case of conjugate fiber, it may be in a composite shape such as sheath and core, side-by-side, three-layers or multi-layers shape, hetero-multiple layer shape, and the like. In combining two or more different thermoplastic resins composing the conjugate fiber, it is preferable to use those in which the difference of melting points is 10° C. or more each other. And preferably, among the thermoplastic resins composing the conjugate fiber, the low-melting thermoplastic resin is exposed on at least one part of the surface of the conjugate fiber, of which the structure is continued in the direction of the long axis of the fiber. In addition, it is preferable that the low-melting thermoplastic resin is olefin resins. In producing processed goods or non-woven fabrics using such tow of conjugate fiber, the temperature for thermal treatment is fixed at the softening point (or melting point) or higher of the low-melting thermoplastic resin and a temperature lower than the softening point (or melting point) of the higher-melting thermoplastic resin. Thus, the low-melting thermoplastic resin is melted to thermally adhere the fiber each other at the crossing points to produce processed goods or non-woven fabrics having three-dimensional network.

When a combination of the low-melting thermoplastic resin and the higher-melting thermoplastic resin composing the conjugate fiber is represented by the low-melting thermoplastic resin/the higher-melting thermoplastic resin, the followings are exemplified: high-density polyethylene/polypropylene, low-density polyethylene/propylene-ethylene-butene-1 crystalline copolymer, high-density polyethylene/polyethylene terephthalate, nylon-6/nylon 66, low-melting polyester/polyethylene terephthalate, polypropylene/polyethylene terephthalate, polyvinylidene fluoride/polyethylene terephthalate, a mixture of linear low-density polyethylene and high-density polyethylene/polyethylene, and the like. Among them, a combination of those selected from polyolefin resins and polyester resins is preferred, for example, high-density polyethylene/polypropylene, low-density polyethylene/propylene-ethylene-butene-1 crystalline copolymer, high-density polyethylene/polyethylene terephthalate, low-melting polyester/polyethylene terephthalate, polypropylene/polyethylene terephthalate, linear low-density polyethylene/polyethylene terephthalate, and the like, are exemplified.

The weight percent of the low-melting thermoplastic resin to the higher-melting thermoplastic resin composing the conjugate fiber is as follows. The content of the low-melting thermoplastic resin is in 10 to 90% by weight and that of the higher-melting thermoplastic resin is in 90 to 10% by weight, and preferably that of the low-melting thermoplastic resin is in 30 to 70% by weight and that of the higher-melting thermoplastic resin is in 70 to 30% by weight. When the content of the low-melting thermoplastic resin is less than 10% by weight, the resulting conjugate fiber is insufficient in thermoadhesion, and the use of such conjugate fiber results in decrease of tenacity of the processed goods and non-woven fabrics. To the contrary, when the content of the low-melting thermoplastic resin is more than 90% by weight, it melts excessively during thermal treatment of the processed goods or non-woven fabrics, which are then converted into films.

The thermoplastic resin, a raw material of the synthetic fiber composing the tow of the invention, may contain an antioxidant, light stabilizer, ultraviolet absorbent, neutralizing agent, nuclear-forming agent, epoxy stabilizer, lubricant, antimicrobial, flame retardant, anti-static agent, pigment, plasticizer, other thermoplastic resin, and the like, as far as they do not disturb the effect of the invention. The tow of the invention is a bundle of synthetic fiber, in which the fineness of single yarn is in a range of 0.5 to 100 dtex, preferably, 1 to 80 dtex, and the total fineness is in a range of 10,000 to 300,000 dtex. The tow, when used as a raw material for non-woven fabrics, wound protector, bandage, cataplasm, etc., for which softness or texture is required, is preferably used as 0.5 to 15 dtex of the fineness of single yarn. When used for filters, wipers, heat-insulating materials, cushion materials, etc., the fineness is preferably 1 to 100 dtex. When the fineness of single yarn is much less than 0.5 dtex, single thread snapping or feather bristling easily occurs at the time of disentangling of the tow to yield twining around a roll and decreases the productivity. When the fineness is much more than 100 dtex, the convergence of the tow decreases to decrease the productivity.

In the tow of the invention, the total fineness is 10,000 to 300,000 dtex, preferably, 50,000 to 200,000 dtex. When the total fineness is much less than 10,000 dtex and much more than 300,000 dtex, convergence of the tow fiber cannot be attained, and the tow is finely fractured and yields tangles of single yarn to decrease the productivity.

In the tow of the invention, the tow density is 1,000 to 8,000 dtex/mm, preferably, 1,500 to 5,000 dtex/mm. When the tow density is much less than 1,000 dtex/mm, convergence of the tow is lost and the tow is fractured. Single yarns produced by the tow fracture are entangled each other or twine around a roll to decrease the productivity of the tow. In addition, in the course of packing in a case for transportation or movement or picking-up of tow during the processing, fracture of tow may happen very often to cause inconvenience such as tangle or twist. Moreover, in producing processed goods from the tow, disentanglement of the tow, i.e., loosening of the twisted tow to a single yarn unit disturbs the character of tow that extends uniformly and widely. When the tow density is much more than 8,000 dtex/mm, there is a fear that the tow of which the crimp is uniform could not be obtained.

The synthetic fiber composing the tow of the invention has crimps. Such crimps may be any of apparent crimps and/or latent crimps. The shape of crimps may be of uneven zigzag type, U type, spiral type, and the like.

The method for making crimps on the synthetic fiber is exemplified by a method of using a crimper of stuffer box type, a method for pushing with a gas under pressure such as high temperature high pressure vapor or hot high pressure air, or a method for sending tow into a gap of a pair of high-speed revolving apparatus such as a high speed crimper to form crimps.

The number of the apparent crimps in the synthetic fiber is in a range of 3 to 30 crimps/25 mm, preferably 4 to 25 crimps/25 mm, and more preferably 5 to 20 crimps/25 mm. When the number of the crimps is less than 3 crimps/25 mm, convergence of the tow decreases. On the other hand, when the number of the crimps is more than 30 crimps/25 mm, excessive tangle or high density conversion of the synthetic fiber may possibly occur. This is not preferable because disentanglement of tow is decreased.

In the tow of the invention, the leak electric resistance has to be $1\times10^{10}$ Ω or more. When the leak electric resistance is lower than $10^{10}$ Ω, such tow is unsuitable for the use requiring chargeability because the leak electric charge is so much to obtain tow having sufficient chargeability.

The tow as set forth in the above item (2) of the invention comprises thermoplastic resin, in which the fineness of single yarn is 0.5 to 100 deci-tex (dtex), each synthetic fiber has crimps, the total fineness is 10,000 to 300,000 dtex, the value (D/W) obtained by dividing the total fineness (D) by the tow width (W) is 1,000 to 8,000 dtex/mm, and a fiber-processing agent containing a particular polyoxyethylene higher fatty acid ester and/or a particular sorbitan fatty acid ester is applied on the surface of the synthetic fiber. Though the tow has excellent chargeability as its characteristic caused by friction between fiber and metal, fiber and fiber, or fiber and other materials, a harmful effect such as twining on a roll or single thread snapping due to static electricity in the process of production of the tow can be suppressed effectively. Thus, the tow having a uniform tow density and good convergence can be obtained with less occurrence of fracture. Thus resulting tow and its laminate are suitable as raw materials for air filters or wipers catching efficiently dust utilizing the chargeability of tow.

The fiber-processing agent used in the tow of the invention can afford chargeability to the tow. Strictly speaking, the synthetic fiber comprising thermoplastic resin has a character that it can suppress the releasing leak electric charge (synonym of the leak electric resistance) to the minimum against the charge generated by the friction between fiber and fiber, fiber and metal or fiber and other raw material. Therefore, when the tow is produced using the fiber-processing agent under highly dry conditions, there is a fear that twining on a roll or single thread snapping occurs because much electric charge is easily generated by friction. The tow of the invention, however, has high convergence since the synthetic fiber having a particular fineness of single yarn and particular crimps is prepared so as to have a particular tow density and treated with a particular fiber-processing agent which is compatible with the tow having the structure. Thus, occurrence of such a phenomenon as fracture or partial splits of tow can be prevented very well to afford excellent disentanglement.

In order to improve the convergence of tow, it is necessary to use a fiber-processing agent which affords wettability and viscosity to the synthetic fiber composing the tow. In order to obtain homogeneity of the tow density in the direction of the tow width, it is necessary to use a fiber-processing agent with which the synthetic fiber results in the smooth or lubricated state in the crimping step. In addition, in order to enhance the electric charge and improve the chargeability, it is important to suppress the leak charge, so it is necessary to use a non-ionic fiber-processing agent. Such a fiber-processing agent is composed of the components A and B as mentioned below.

The component A in the fiber-processing agent used in the invention is composed of a mixture of a polyoxyethylene higher fatty acid ester and one or more of sorbitan fatty acid esters. The polyoxyethylene higher fatty acid ester has the structure of the following general formula (1):

[General Formula (1)]

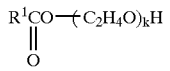

wherein $R^1$ is a saturated or unsaturated aliphatic hydrocarbon group of 5 to 18 carbon atoms; and k is an integer of 2 to 50.

The sorbitan fatty acid esters have the structure of the following general formula (2) or (3):

[General Formula (2)]

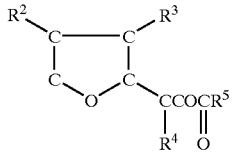

[General Formula (3)]

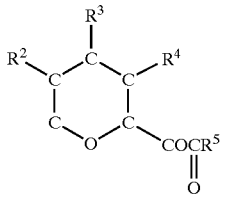

wherein $R^2$, $R^3$ and $R^4$ each is a hydroxyl group or polyoxyethylene group, wherein the polymerization degree of the polyoxyethylene group (repeated unit of the polyoxyethylene group) is 2 to 55; and $R^5$ is a saturated or unsaturated aliphatic hydrocarbon group of 16 to 30 carbon atoms.

The polyoxyethylene higher fatty acid esters and the sorbitan fatty acid esters, which have high wettability and viscosity, are classified into non-ionic surface activators. Specific examples of the polyoxyethylene higher fatty acid esters include polyoxyethylene mono-coconut oil fatty acid, polyoxyethylene caprate, polyoxyethylene laurate, polyoxyethylene myristate, and the like.

Specific examples of the sorbitan fatty acid esters include sorbitan monolaurate, sorbitan monopalmitate, sorbitan monostearate, sorbitan monooleate, sorbitan sesqui-oleate, sorbitan sesqui-stearate, sorbitan trioleate, sorbitan tristearate, sorbitan monoisostearate, coconut oil fatty acid sorbitan esters, and the like. The polyoxyethylene derivatives of sorbitan fatty acid esters are exemplified by polyoxyethylene (EO=4) sorbitan monolaurate, polyoxyethylene (EO=4) sorbitan tristearate, polyoxyethylene (EO=4) sorbitan trioleate, polyoxyethylene (EO=5) sorbitanmonooleate, polyoxyethylene (EO=6) sorbitan monooleate, polyoxyethylene (EO=6) sorbitan monostearate, polyoxyethylene (EO=20) mono-coconut oil fatty acid sorbitan ester, polyoxyethylene (EO=20) sorbitan monopalmitate, polyoxyethylene (EO=20) sorbitan monolaurate, polyoxyethylene (EO=20) sorbitan monostearate, polyoxyethylene (EO=20) sorbitan monoisostearate, polyoxyethylene (EO=20) sorbitan monooleate, polyoxyethylene (EO=20) sorbitan trioleate, polyoxyethylene (EO=20) sorbitan tristearate, and the like. These polyoxyethylene higher fatty acid esters and sorbitan fatty acid esters can be used as commercially available ones.

The component B is a polyoxyethylene higher fatty acid ester, which is represented by the following general formula (4) and/or general formula (5). The polyoxyethylene higher fatty acid esters, which have high wettability and viscosity, are classified into non-ionic surface activators.

[General Formula (4)]

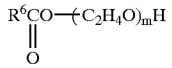

(In the formula, $R^6$ is a saturated or unsaturated aliphatic hydrocarbon group of 16 to 30 carbon atoms; and m is an integer of 2 to 50).

[General Formula (5)]

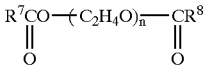

(In the formula, $R^7$ and $R^8$ each is a saturated or unsaturated aliphatic hydrocarbon group of 16 to 30 carbon atoms; and n is an integer of 2 to 50).

Specific examples of the polyoxyethylene higher fatty acid ester include polyoxyethylene (EO=2) stearate, polyoxyethylene (EO=6) stearate, polyoxyethylene (EO=9) laurate, polyoxyethylene (EO=9) stearate, polyoxyethylene (EO=9) oleate, polyoxyethylene (EO=14) laurate, polyoxyethylene (EO=23) stearate, polyoxyethylene (EO=12) linoleate, polyoxyethylene (EO=9) dilaurate, polyoxyethylene (EO=9) distearate, polyoxyethylene dioleate, and the like. The polyoxyethylene higher fatty acid esters may also be used as commercially available ones.

The fiber-processing agent contains 60 to 95% by weight of the component A and 5 to 40% by weight of the component B, based on the processing agent. When the rate of the combination is much against the range, the convergence or smoothness of the tow is lost to possibly cause twining on a roll or single thread snapping in the process of production. The amount of the fiber-processing agent to adhere to the tow is preferably in a range of 0.1 to 1.5% by weight on average. In this range of the amount of adhesion, good convergence can be attained to avoid twining on a roll or single thread snapping. In addition, it is possible to avoid stains in the processing machine or undesired stickiness on the synthetic fiber caused by an excess amount of the fiber-processing agent.

The fiber-processing agent used in the invention, in addition to the components A and B, may contain if required an anti-oxidant, preservative, rust-proofing, antimicrobial, wetting agent, and the like, within a range in which the effect of the invention is not disturbed. The fiber-processing agent may usually be diluted in water, etc., in using.

As an example of the chargeable tow of the invention, the followings indicate a process for producing the tow of a conjugate fiber shape.

Using a sheath and core or ecentric core and sheath spinneret which forms the sheath portion made of a low-melting thermoplastic resin and the core portion made of a high-melting thermoplastic resin, or using a parallel-type spinneret in which the low-melting thermoplastic resin is in parallel with the high-melting thermoplastic resin, these thermoplastic resins are spun out of a melt fiber spinning machine so that the low-melting thermoplastic resin forms at least one part of the fiber surface. At this stage, air is sent directly under the spinneret with a quencher to cool the thermoplastic resin which has been spun out in a half-melting state. Thus, a thermoadhesive conjugate fiber can be produced in a non-drawing state. At this stage, the amount of the melted thermoplastic resin to be put out and the rate of winding of the non-drawing yarn prepared from the resin are optionally fixed to yield a non-drawing yarn having 1 to 5-fold size in diameter for the objective fineness. At this stage, when the rate of the low-melting thermoplastic resin forming the fiber surface is 50% or more of the ratio of the circumference of a circle to its diameter in the fiber section, sufficient adhesion force can preferably be obtained. The resulting non-drawing yarn is then extended with a conventional drawing machine to yield drawn yarn.

In carrying out the usual drawing treatment, the resulting non-drawn yarn is passed through plural rolls heated at 40 to 120° C., which are rotated respectively at different speeds. At this stage, it is preferred to fix the ratio of the speed between the rolls in a range of 1:1.1 to 1:5. The resulting drawn yarn is afforded crimps with a crimping machine of box-type to yield crimped drawn yarn, which is converged to yield tow. This is dried in a drier fixed at 60 to 120° C. The fiber-processing agent may adhere by kiss roll at the fiber spinning step or by touch roll at the drawing step. In this invention, however, it is appropriate to conduct adhesion at the fiber spinning step in order to enhance convergence of the synthetic fiber and suppress fracture of the tow. In this connection, it is appropriate to adjust the homogeneity of convergence of the tow during introduction of the tow into a crimper, so that the resulting tow density is within the scope of the invention.

The tow of the invention includes those produced by mixing the synthetic fiber with another fiber. The other fiber mixed with the synthetic fiber is exemplified by thermoplastic tow or fiber which is different in its component, fineness, conjugate shape, thermoadhesive temperature, thermal shrinkage behavior, dyeing behavior, hue, water-absorbing property, etc. In addition to the thermoplastic fiber, cotton, rayon, glass fiber, carbon fiber, and the like are exemplified. Alternatively, it is possible to laminate at least one selected from non-woven fabrics, films, pulp sheets, knitting, and textiles on the tow or the tow mixed with the other fiber.

The shape of the laminate may be formed, for example, by disentangling tow to web and laminating the web on another non-woven fabric or film, or by laminating the web on another non-woven fabric or film followed by heat melting treatment, or by heat melting treatment of the web/pulp/film laminate. It is also possible to mix the web with pulp, etc., to give non-woven fabrics, which may be used as materials for laminating. These laminate products can be used for absorbent goods such as paper napkins absorbing urine and soft feces for newborn babies, paper napkins mainly absorbing urine for infants, sanitary napkins, pats for wound, pats for sweat, wipers absorbing liquid, sheets absorbing liquid, and the like. Particularly, they can be used preferably for air filters or wipers since they have excellent properties catching or absorbing dust in view of their chargeability caused by friction between fiber and fiber or other material.

The present invention will be explained by the following Examples and Comparative Examples, which are not intended as a limitation thereof. The methods for measurement of the physicochemical properties as shown in the Examples and Comparative Examples and the definition thereof are shown together as follows.

(1) Amount of the fiber-processing agent adhering (%):

Synthetic fiber (2 g) was extracted with 25 ml of methanol, and the methanol only was evaporated from the methanol extract. The residue was weighed, and the weight of the extracted fiber-processing agent (g) was measured. The rate of the fiber-processing agent adhering to the synthetic fiber was calculated by means of the following equation.

The weight of the extracted fiber-processing agent/(2 −the weight of the extracted fiber-processing agent)×100.

(2) Tow density (D/W):

The value obtained by dividing the total fineness of tow by the tow width, which indicates the fineness of tow per unit tow. The unit is represented by dtex/mm.

(3) Tow thickness:

The thickness of tow was measured at the 5 points, and the average value was calculated. The thickness was measured with a Degi-Thickness tester (made by Toyo Seiki Seisaku-Sho, Ltd.).

(4) Tow convergence:

The state and points of tow fractures per 1 m tow length were observed. When the completely separated fracture was observed at 0 or 1 point, the criterion of judgement was regarded as good, and when it was at 2 or more points, as bad.

(5) Disentanglement coefficient:

Tow was drawn and disentangled in a disentangling machine of pinch roll type at a rate of 60 m/min and 1.5-fold magnification, and the value obtained by dividing the resulting tow width by the tow width before the disentanglement was regarded as disentanglement coefficient. When the coefficient is in a range of 3 to 25, the disentanglement is regarded as good. When the coefficient is less than 3, the disentanglement in high-rate production is poor in homogeneity. On the other hand, when the coefficient is over 25, tow fracture is produced in the step of disentanglement with a disentangling machine.

(6) Quantity of static electricity generated (volt):

Tow was cut into 50 mm in the direction of the long axis and passed through a roller card machine. When the tow becomes web at the position from a flycom to a drum, the quantity of static electricity generated on the tow was measured with a current collecting potentiometer KS-525. In this operation, the temperature and humidity were fixed at 20° C. and 40% RH, respectively. Larger value means that the tow is better in chargeability.

(7) Leak electric resistance (Ω):

Tow was cut into 50 mm in the direction of the long axis, of which 30 g was placed in a 200 cc beaker and forced to put into it with a glass stick. Using a super insulation tester SM-8203 (made by Toa Denpa Kogyo, Ltd.), the electrode was placed on the tow under load of 2 kg, and the resistance was measured under the measurement voltage of 5 V. Larger value means that the tow has an easily chargeable character and the charge is scarcely leaked.

(8) Productivity:

In a series of steps including fiber spinning, drawing, forming of crimps, and drying, the state of twining on a roll or apparatus or single thread snapping was observed. The case of no problem was recorded as good, and when questionable, the details were noted.

The components of the fiber-processing agents used in Examples and Comparative Examples are shown in Table 1.

EXAMPLE 1

Conjugate fiber which contained a high-density polyethylene (HDPE) as a sheath component and polypropylene (PP) as a core component and of which the composite ratio was 50/50% by weight were spun under fusing to give non-drawn yarn. During melt fiber spinning, water containing 2.5% by weight of the fiber-processing agent as described in Table 1 was made adhered to the conjugate fiber using a kiss roll. The non-drawn yarn of conjugate fiber to which adhered the fiber-processing agent was drawn at a temperature of 90° C. and 3.2-fold drawing magnification. Then, 15 crimps/25 mm of crimps were formed thereon with a crimper of stuffer box type of 27 mm width to yield tow of which the fineness of single yarn was 3.1 dtex and the total fineness was 115000 dtex.

In this operation, crimps were afforded to the conjugate fiber while suppressing self-exotherm generated by pressure welding of the tow in the crimper box by spraying water to the tow immediately before introduction into the crimper (at the final stage of the drawing step). Then, the tow on which was formed crimps (converged conjugate fiber) was heated at 100° C. for 5 minutes to remove moisture. For the resulting tow, the single yarn strength, elongation, amount of the fiber-processing agent adhering, tow density (D/W), tow thickness, tow convergence, disentanglement coefficient, quantity of static electricity generated, and leak electric resistance were measured according to the above-mentioned methods. Table 3 shows the results.

EXAMPLES 2 TO 9 AND COMPARATIVE EXAMPLES 1 AND 2

Tow was prepared according to the conditions as mentioned in Table 2 below, but otherwise according to those in Example 1. For the resulting tow, the single yarn strength, elongation, amount of the fiber-processing agent adhering, tow density (D/W), tow thickness, tow convergence, disentanglement coefficient, quantity of static electricity generated, and leak electric resistance were measured according to the above-mentioned methods. Tables 3 and 4 show the results. In Table 2, PET indicates polyethylene terephthalate.

EXAMPLE 10

The tow prepared in Example 2 was laminated on a span-bond non-woven fabric of 20 g/m$^2$, and continuously processed for heat-seal at intervals of 3 cm in the direction of the tow width to yield a laminate in which the tow was unified with the span-bond non-woven fabric. The laminate had high chargeability.

As seen clearly from Tables 3 and 4, it is understood that the tow of the invention as prepared in Examples 1 to 9 is excellent in chargeability since the tow comprises synthetic fiber of thermoplastic resin, of which the fineness of single yarn is in a range of 0.5 to 100 deci-tex (dtex), in which each synthetic fiber has crimps, the total fineness is in a range of 10,000 to 300,000 dtex, and the tow density is in a range of 1000–8000 dtex/mm, and of which the leak electric resistance is $1\times10^{10}$ Ω or more. Particularly, the tow in Examples 1 to 7, to which adheres 0.1 to 1.5% by weight of a fiber-processing agent composed of Component A comprising a particular polyoxyethylene higher fatty acid ester and a particular sorbitan fatty acid ester and Component B comprising a particular polyoxyethylene higher fatty acid ester, is excellent in convergence though it has chargeability. Thus, since there is no trouble such as twining on a roll or single thread snapping in each step of production of tow, i.e., fiber spinning, drawing, forming of crimps, and drying, the productivity was very good.

The tow in Example 8 has been treated with a fiber-processing agent which contains no particular sorbitan fatty acid ester composing Component A but a particular polyoxyethylene higher fatty acid ester only, but its convergence is apparently very good with a high leak electric resistance and excellent chargeability. In the tow in Example 9, the fiber-processing agent has adhered thereto in an amount of 0.05% by weight, which is slightly less than that usually used, so that tow fracture and twinning of single yarn on a roll apparatus were somewhat observed. The leak electric resistance, however, is $1\times10^{10}$ Ω or more, which value indicates the tow having excellent chargeability.

Tow in Comparative Example 1, to which has adhered a fiber-processing agent comprising an anion surface activator, i.e., the potassium salt of an alkyl phosphate in which the alkyl group has 16 carbon atoms, had no trouble such as twining on a roll or single thread snapping. The leak electric resistance, however, was less than $1\times10^{10}$ Ω and the quantity of generated static electricity in the tow was 0. This means the tow has no chargeability.

In the tow in Comparative Example 2, the tow density is quite small as 905 dtex/mm. Thus, the convergence of tow was worse, and occurrence of tow fracture and twining on a roll due to the fracture was observed and resulted in worse workability.

TABLE 1

Effective component of the fiber-processing agent used in Examples and Comparative Examples

| | First Component or Component A | | Second Component or Component B | |
|---|---|---|---|---|
| | Component | Rate % | Component | Rate % |
| Fiber-processing agent 1 | Polyoxyethylene coconut oil fatty acid | 90 | Polyoxethylene (EO = 9) stearate | 10 |
| Fiber-processing agent 2 | Polyoxyethylene coconut oil fatty acid | 85 | Polyoxethylene (EO = 9) dioleate | 15 |

TABLE 1-continued

Effective component of the fiber-processing agent used in Examples and Comparative Examples

| | First Component or Component A | | Second Component or Component B | |
|---|---|---|---|---|
| | Component | Rate % | Component | Rate % |
| Fiber-processing agent 3 | Polyoxyethylene coconut oil fatty acid + Sorbitan mono-stearate (70/30) | 90 | Polyoxethylene (EO = 2) stearate | 10 |
| Fiber-processing agent 4 | Polyoxyethylene laurate + (80/20) Polyoxyethylene (EO = 20) sorbitan monostearate (80/20) | 80 | Polyoxethylene (EO = 9) stearate | 20 |
| Fiber-processing agent 5 | Polyoxyethylene coconut oil fatty acid | 100 | | |
| Fiber-processing agent 6 | Sorbitan monostearate | 80 | C16 alkyl phosphate potassium salt | 20 |

TABLE 2

Conditions for production of tow

| | Sheath Resin | Core Resin | Sheath/Core ratio | Agent No. | Drwg. Temp. | Drwg. Magn. | Crimper | Crimper Width |
|---|---|---|---|---|---|---|---|---|
| Example 1 | HDPE | PP | 50/50 | 1 | 90 | 3.2 | Stuffer box type | 27 |
| Example 2 | HDPE | PET | 60/40 | 1 | 90 | 3.2 | High speed crimper | 17 |
| Example 3 | HDPE | PP | 60/40 | 2 | 90 | 3.2 | Stuffer box type | 27 |
| Example 4 | HDPE | PP | 50/50 | 3 | 90 | 3.2 | Stuffer box type | 27 |
| Example 5 | HDPE | PP | 50/50 | 4 | 90 | 3.2 | High speed crimper | 17 |
| Example 6 | HDPE | PET | 50/50 | 2 | 90 | 3.2 | Stuffer box type | 27 |
| Example 7 | HDPE | PP | 50/50 | 2 | 90 | 3.2 | Stuffer box type | 27 |
| Example 8 | HDPE | PET | 60/40 | 5 | 90 | 3.2 | High speed crimper | 17 |
| Example 9 | HDPE | PET | 60/40 | 5 | 90 | 3.2 | High speed crimper | 17 |
| Com.Ex. 1 | HDPE | PP | 50/50 | 6 | 90 | 3.2 | Stuffer box type | 27 |
| Com.Ex. 2 | HDPE | PP | 50/50 | 1 | 90 | 3.2 | Stuffer box type | 27 |

Remark:
Agent No. = Fiber-processing agent
Drwg.Temp. = Drawing temperature
Drwg.Magn. = Drawing magnification

TABLE 3

Physicochemical properties of Tow

| | | Example 1 | Example 2 | Example 3 | Example 4 | Example 5 | Example 6 | Example 7 |
|---|---|---|---|---|---|---|---|---|
| Amt.of Agent | % | 0.36 | 0.48 | 0.41 | 0.38 | 0.32 | 0.55 | 0.7 |
| Fineness | dtex | 3.1 | 3.3 | 2.1 | 2.2 | 2.1 | 3.3 | 2.2 |
| Yarn strength | cN/dtex | 2.5 | 1.7 | 2.4 | 2.5 | 2.6 | 1.8 | 2.5 |
| Elongation | % | 115 | 90 | 86 | 103 | 75 | 85 | 60 |
| Total fineness(D) | dtex | 115000 | 82000 | 78000 | 82000 | 104000 | 123000 | 191000 |
| Width (W) | mm | 35 | 22 | 37 | 35 | 28 | 35 | 35 |
| Density (D/W) | dtex/mm | 3286 | 3727 | 2108 | 2343 | 3714 | 3514 | 5457 |
| Thickness | mm | 4.3 | 4.2 | 3.7 | 3.3 | 4.9 | 5.0 | 8.1 |
| Convergence | | Good | good | Good | good | good | good | good |

TABLE 3-continued

| Physicochemical properties of Tow | | Example 1 | Example 2 | Example 3 | Example 4 | Example 5 | Example 6 | Example 7 |
|---|---|---|---|---|---|---|---|---|
| Disentangle Coefficient | | 6.1 | 7.5 | 4.3 | 4.5 | 8.3 | 7.2 | 5.2 |
| Static electricity | volt | 2300 | 2000 | 1900 | 2000 | 2300 | 2100 | 2200 |
| Leak electric resistance | Ω | $2.2 \times 10^{11}$ | $>2.5 \times 10^{11}$ | $2.0 \times 10^{11}$ | $1.8 \times 10^{11}$ | $2.5 \times 10^{11}$ | $2.1 \times 10^{11}$ | $>1.5 \times 10^{11}$ |
| Productivity | | Good | good | Good | good | good | good | good |

Remarks:
Amt.of Agent = Amount of fiber-processing agent;
Fineness = Fineness of single yarn;

TABLE 4

| Physicochemical properties of Tow | | Example 8 | Example 9 | Com. Ex. 1 | Com. Ex. 2 |
|---|---|---|---|---|---|
| Amt.of Agent | % | 0.45 | 0.05 | 0.4 | 0.3 |
| Fineness | dtex | 3.3 | 3.3 | 3.2 | 2.2 |
| Yarn strength | cN/dtex | 1.8 | 2.0 | 2.4 | 2.5 |
| Elongation | % | 98 | 70 | 80 | 65 |
| Total fineness(D) | dtex | 82000 | 82000 | 115000 | 54300 |
| Width (W) | mm | 25 | 45 | 35 | 60 |
| Density (D/W) | dtex/mm | 3280 | 1822 | 3280 | 905 |
| Thickness | mm | 4.3 | 2.8 | 4.0 | 1.1 |
| Convergence | | good | bad | good | bad |
| Disentangle Coefficient | | 1.5 | 3.2 | 6.0 | 2.5 |
| Static electricity | volt | 3000 | 2500 | 0 | 1800 |
| Leak electric resistance | Ω | $>2.5 \times 10^{11}$ | $2.1 \times 10^{11}$ | $1.4 \times 10^{8}$ | $1.2 \times 10^{11}$ |
| Productivity | | adhesion, twining positive | twining positive | good | twining positive |

Remarks:
Amt.of Agent = Amount of fiber-processing agent;
Fineness = Fineness of single yarn;

The tow of the invention has a particular tow structure of which the leak electric resistance is $1\times10^{10}$ Ω or more, or it has a particular tow structure in which a fiber-processing agent containing a polyoxyethylene higher fatty acid ester and a sorbitan fatty acid ester has been applied on the surface of fiber, preferably in a particular amount for the tow. Thus, the tow has a character that tow fracture scarcely occurs because of high convergence of the tow, though it has chargeability due to friction, and can be produced without causing twining on a roll or single thread snapping in the process of tow production. Moreover, the tow can suitably be applied to use as air filters or wipers efficiently catching dust utilizing its chargeability.

What is claimed is:

1. Chargeable tow which comprises synthetic fiber of thermoplastic resin, of which the fineness of single yarn is 0.5 to 100 deci-tex (dtex), in which each synthetic fiber has crimps, the total fineness is 10,000 to 300,000 dtex, and the value (D/W) obtained by dividing the total fineness (D) by the tow width (W) is in a range of 1000–8000 dtex/mm, and of which the leak electric resistance is $1\times10^{10}$ Ω or more.

2. Chargeable tow as claimed in claim 1, wherein the synthetic fiber composing tow has the apparent crimp number of 5 to 30 crimps/25 mm.

3. Chargeable tow as claimed in claim 1, wherein the fineness of the single yarn is 1 to 30 dtex, and the total fineness is 50,000 to 200,000 dtex.

4. Chargeable tow as claimed in claim 1, wherein the synthetic fiber composing the tow is of thermoplastic resin selected from polyolefins, polyesters and polyamides.

5. Chargeable tow as claimed in claim 1, wherein the synthetic fiber composing the tow is conjugate fiber composed of a low melting thermoplastic resin and a high melting thermoplastic resin.

6. Chargeable tow as claimed in claim 5, wherein at least one of the thermoplastic resins composing the conjugate fiber is an olefin resin, which is continuously exposed on a part of the surface of the fiber parallel to the direction of the long axis of the fiber.

7. Laminate in which at least one selected from other non-woven fabrics, films, pulp sheets, knitting, and textiles is laminated on the chargeable tow as claimed in claim 1.

8. A filter comprising the laminate as claimed in claim 7.

9. A wiper comprising the laminate as claimed in claim 7.

10. A filter comprising the chargeable tow as claimed in claim 1.

11. A wiper comprising the chargeable two as claimed in claim 1.

12. Chargeable tow which comprises synthetic fiber of thermoplastic resin, of which the fineness of single yarn is 0.5 to 100 deci-tex (dtex), in which each synthetic fiber has crimps, the total fineness is 10,000 to 300,000 dtex, and the value (D/W) obtained by dividing the total fineness (D) by the tow width (W) is in a range of 1,000 to 8,000 dtex/mm, and to which has adhered a fiber-processing agent containing components A and B (60 to 95% by weight of the component A and 5 to 40% by weight of the component B, based on the fiber-processing agent), wherein the component A is a mixture of a polyoxyethylene higher fatty acid ester of the following general formula (1) and one or more species of a sorbitan fatty acid ester of the following general formula (2) or (3); and the component B is a polyoxyethylene higher fatty acid ester of the following general formula (4) and/or general formula (5):

[General Formula (1)]

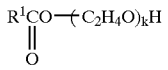

wherein $R^1$ is a saturated or unsaturated aliphatic hydrocarbon group of 5 to 18 carbon atoms; and k is an integer of 2–50,

[General Formula (2)]

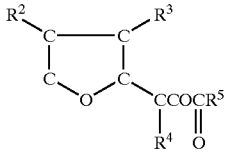

[General Formula (3)]

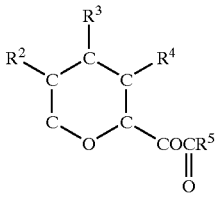

wherein $R^2$, $R^3$ and $R^4$ each is a hydroxyl group or polyoxyethylene group, wherein the polymerization degree of the polyoxyethylene group (repeated unit of the polyoxyethylene group) is 2 to 55; and $R_6$ is a saturated or unsaturated aliphatic hydrocarbon group of 16 to 30 carbon atoms,

[General Formula (4)]

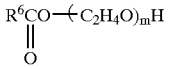

wherein $R^6$ is a saturated or unsaturated aliphatic hydrocarbon group of 16 to 30 carbon atoms; and m is an integer of 2 to 50, and

[General Formula (5)]

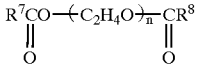

wherein $R^7$ and $R^8$ each is a saturated or unsaturated aliphatic hydrocarbon group of 16 to 30 carbon atoms; and n is an integer of 2 to 50.

13. Chargeable tow as claimed in claim 12, wherein the fiber-processing agent adheres at a rate of 0.1 to 1.5% by weight for the tow.

14. Chargeable tow as claimed in claim 13, wherein the fineness of the single yarn is 1 to 30 dtex, and the total fineness is 50,000 to 200,000 dtex.

15. Chargeable tow as claimed in claim 12, wherein the synthetic fiber composing tow has the apparent crimp number of 5 to 30 crimps/25 mm.

16. Chargeable tow as claimed in claim 12, wherein the fineness of the single yarn is 1 to 30 dtex, and the total fineness is 50,000 to 200,000 dtex.

17. Chargeable tow as claimed in claim 12, wherein the synthetic fiber composing the tow is of thermoplastic resin selected from polyolefins, polyesters and polyamides.

18. Chargeable tow as claimed in claim 12, wherein the synthetic fiber composing the tow is conjugate fiber composed of a low melting thermoplastic resin and a high melting thermoplastic resin.

* * * * *